US005704821A

United States Patent [19]

Mann

[11] Patent Number: 5,704,821

[45] Date of Patent: Jan. 6, 1998

[54] BUBBLE BLOWING TOY

[75] Inventor: Leslie Mann, Tsuen Wan, Hong Kong

[73] Assignee: HBL Limited, Hong Kong

[21] Appl. No.: 654,002

[22] Filed: May 29, 1996

Related U.S. Application Data

[63] Continuation of Ser. No. 506,650, Jul. 25, 1995, abandoned, which is a continuation of Ser. No. 289,538, Aug. 12, 1994, abandoned.

[51] Int. Cl.[6] ..... A63H 33/28

[52] U.S. Cl. ..... 446/16; 446/26; 446/74; 446/77

[58] Field of Search ..... 446/15–21, 26, 446/71, 74, 75, 77; D21/61

[56] References Cited

U.S. PATENT DOCUMENTS

| | | | |
|---|---|---|---|
| 2,587,535 | 2/1952 | Scott | 446/18 |
| 3,520,077 | 7/1970 | Bockhacker | 446/16 |
| 3,736,694 | 6/1973 | Lebensfeld | 446/16 |
| 3,845,583 | 11/1974 | Ziff | 446/17 |
| 3,848,355 | 11/1974 | Weight | 446/17 |
| 5,049,103 | 9/1991 | Pearl | 446/19 |
| 5,246,046 | 9/1993 | Schramm | 446/20 |

FOREIGN PATENT DOCUMENTS

| | | | |
|---|---|---|---|
| 696574 | 10/1964 | Canada | 446/15 |

*Primary Examiner*—Robert A. Hafer
*Assistant Examiner*—Jeffrey D. Carlson
*Attorney, Agent, or Firm*—Burns, Doane, Swecker & Mathis

[57] ABSTRACT

An improved bubble blowing device with a bubble forming ring which is hidden inside a decorative housing when not in use. When in use, the elevation angle and the positions of the bubble-forming ring can be adjusted and the bubble forming process observable by the user. The bubble blowing device is provided with a wrist strap such that it can be worn on either wrist. The lid includes a timepiece.

2 Claims, 3 Drawing Sheets

BUBBLE BLOWING TOY

This application is a continuation of application Ser. No. 08/506,650, filed Jul. 25, 1995, which is a continuation of application No. 08/289,538, filed Aug. 12, 1994 both now abandoned.

FIELD OF THE INVENTION

The present invention relates to improvements in bubble blowing toys, in particular, it relates to a bubble blowing toy with a bubble forming ring which ring is hidden inside a decorative housing when not in use. When in use, the elevation angle of the bubble forming ring can be adjusted and the bubble formation process is observable by the user.

BACKGROUND OF THE INVENTION AND PRIOR ART

Toys have become inseparable from the healthy growth of children and most children are attracted by toys that can produce bubbles which can travel for some distance before vanishing. However, many bubble producing toys simply become a routine monotonous bubble producer after a short period of fun-time and play no role in inspiring children to pursue the physical principle behind the bubbles.

U.S. Pat. No. 2,853,829 discloses a bubble making toy incorporating a comic toy figure, such a toy have an amusing appearance but it can not be educational for young children as the mechanism is concealed and too complicated for their appreciation. Further, children easily become bored by looking at the same facial expression repeatedly.

U.S. Pat. No. 4,804,346 discloses a hand-held bubble blowing device which requires the blower's direct oral contact with a blowing pipe to produce bubbles. Such devices may cause potential health problems as children like to exchange toys. More importantly, the bubble generating process is completly concealed within a housing such that children can not appreciate the underlying physical principles thereby preventing children from cultivating an interest in natural science in their early childhood.

SUMMARY OF THE INVENTION

It is therefore an object of the present invention to provide an improved educational bubble blowing toy which brings fun and surprise to children.

According to the present invention there is therefore provided an improved bubble blowing device comprising a wrist strap, a rigid housing made of non-permeable material and being capable of fluid storage, a lid adapted to open and close the said housing, a bubble-forming means which can be completely received inside the said housing, and an adjusting means moving said bubble forming means, between a position in which said bubble forming means is received within said housing and a position in which said bubble forming means extends out of said housing.

Preferably the bubble-forming means can be adjusted and maintained in a range of elevations and positions relative to the said housing.

Preferably a releasable decorative surface can be attached onto the said lid.

Also, children have a craving for wrist watches which, among children of today, means fashion and maturity. It is therefore also an object of the present invention to provide a releasable decorative surface that can be attached onto the said lid. Preferably the said decorative surface that is a time piece.

BRIEF DESCRIPTION OF THE DRAWINGS

A preferred embodiment of the present invention will now be described by way of example and with reference to the accompanying drawings, in which.

DETAILED DESCRIPTION OF THE DRAWINGS

Figure 1:
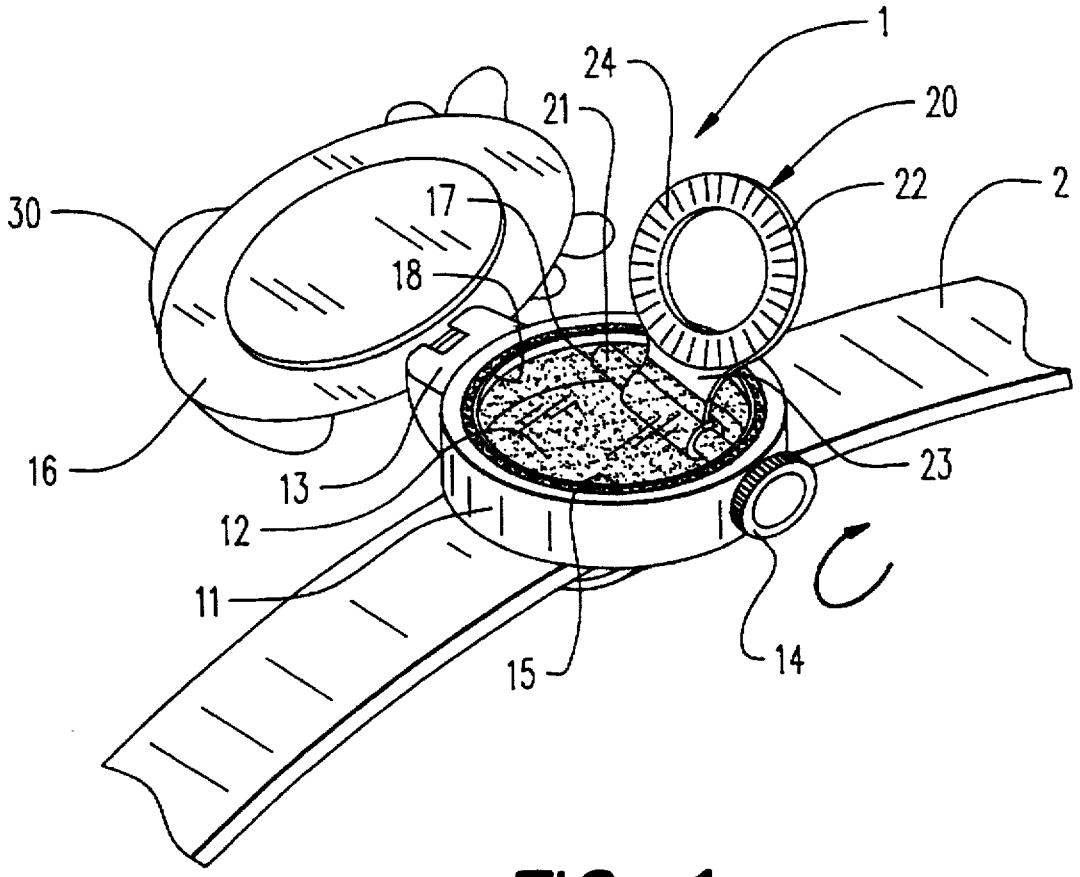
FIG. 1 is a perspective view of a bubble blowing device in accordance with the present invention, showing the lid thereof in an opened position and the film forming ring elevated.
Figure 2:
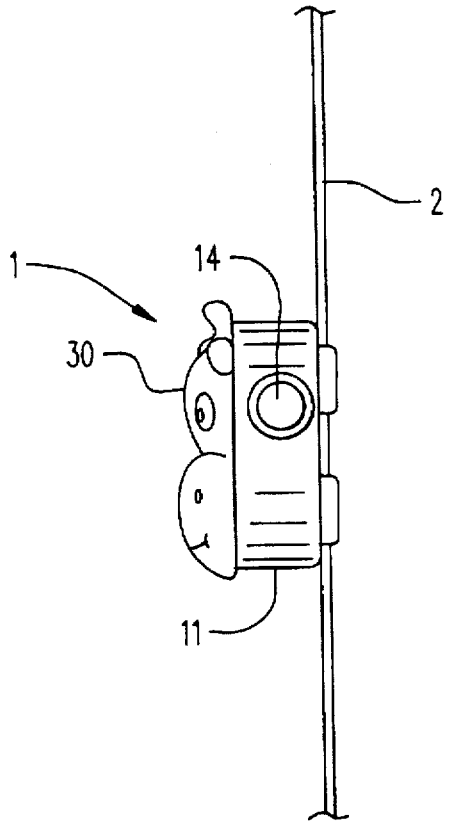
FIG. 2 is a side elevation of the present invention with the lid in its closed position.
Figure 3:
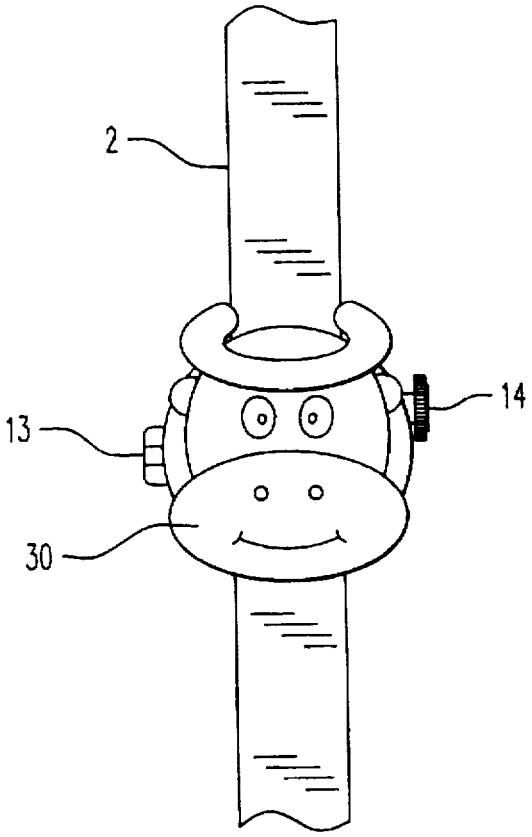
FIG. 3 is the plan view of the present invention with the lid in its closed position.
Figure 4:
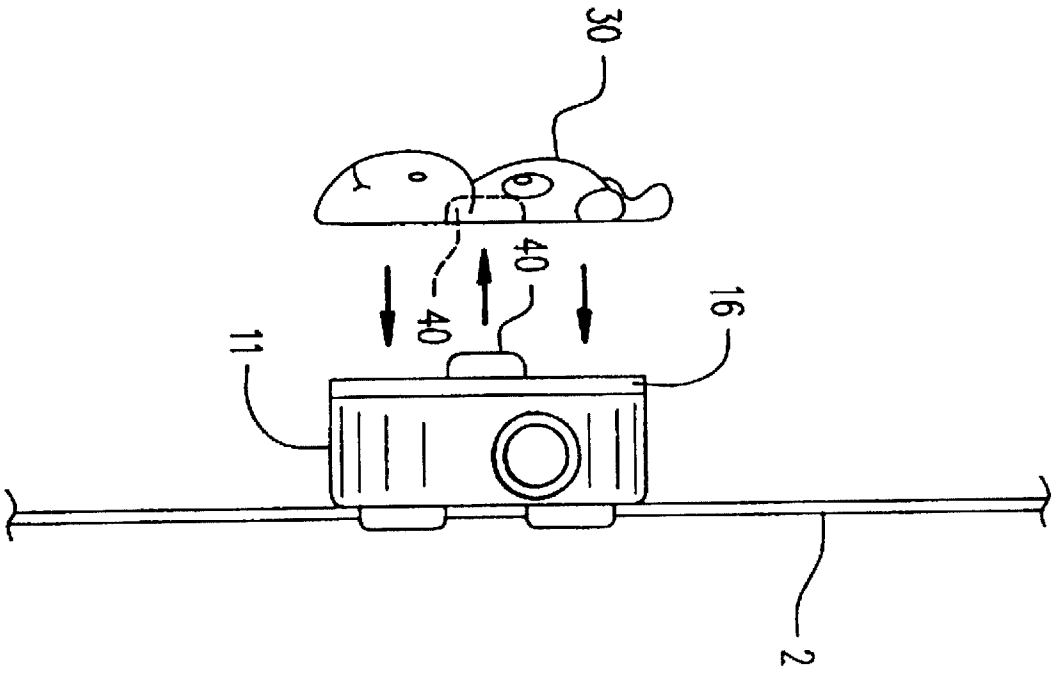
FIG. 4 is the side view of the present invention showing the releasable decorative cover.

Referring to the figures there is provided a bubble blowing device 1 with a wrist strap 2, said wrist strap 2 being of the type commonly used for wrist watches such that users can adjust the length and wear it on either wrist. The bubble blowing device 1 according to the present embodiment comprises a housing 11 made preferably of a rigid non-permeable material such as plastics, hard rubber or metal, said housing 11 comprises a cavity 12 for bubble-forming fluid storage, a hinge 13 and an adjusting means 14 which resembles the crown of a wrist watch. Along the upper edge of cavity 12 of the housing 11 there is provided a sealing band 15 which is preferably made of a water resistant resilient material. A lid 16 for sealing the cavity 12 is hinged to the housing 11 such that, when the lid 16 is pressed and held against the sealing band 15, the cavity 12 is closed and the fluid stored therein would not be spilled even if the device 1 is not maintained in an upright position. The housing 11 and cavity 12 described in the present embodiment are substantially circular. However, it would be understood that other shapes and combinations thereof can be used.

Inside the fluid storage cavity 12 there is mounted an adjustable film-forming means 20, said film-forming means 20 comprising an axle 21, a film-forming ring 22 and an abutment means 23 connecting the film-forming ring 22 to the axle 21. One end of the said axle 21 being connected to the adjusting means 14 while the other end is supported by a complementary recess 17 on the inside wall 18 of the housing 11 such that the axle 21 can be rotated by turning the adjusting means 14, thereby tilting the film-forming ring 22. The film-forming ring 22 is made preferably of a rigid and non-absorbent material such as plastics and the maximum inner diameter of the ring 22 depends on the surface tension of the bubble-forming fluid and should not exceed that which would allow automatic formation of film on the inner annular opening 23.

In order to operate the device in the desired manner, the cavity 12 is firstly charged with bubble-forming fluid and then sealed by closing the lid 16 to prevent leakage. In operation, the lid 16 is opened and the adjusting means 14 rotated clockwise, thereby elevating and tilting the film-forming ring 22 which was previously dipped in the bubble forming fluid. By blowing against the film formed on the ring 22, bubbles are generated and propelled in accordance with the blowing direction. In this bubble blowing exercise, children can actually observe the formation and retaining of a film on the film-forming ring after dipping in the fluid and that different sizes of bubbles are formed according to the elevation angle of the bubble-forming ring 22. They will also appreciate that most bubbles are formed when the plane of the film is orthogonal to the blowing direction. To enhance the fluid retaining and entrapping capability of the film-forming ring, there are further provided ridges 24 which are radially and evenly distributed along the circumference of the ring 22.

There is further provided an releasable decorative surface 30 or disguise which can be attached to the top surface of the covering lid by, for example, a lug-and-hole or clip assembly 40. Such a releasable decorative surface 30 can be in the form of animals, cartoon characters, singers or movie stars such that a single base unit can accommodate the need of children of differnt age groups. For an individual owner, different decorative attachments can be kept and may be used for different occasions, thereby saving the need for one base unit for every different decoarative surface and preserve the environment. The decorative surface 30 can also be a time-piece such that children can have a combined watch and bubble-blowing device. As so many forms of disguise are possible for this device, it brings fun and surprise for children during their growth.

While the invention has been described with respect to a preferred embodiment, it will be appreciated that many variations, modifications and applications of the invention may be made.

I claim:

1. A bubble blowing toy comprising:

a wrist strap whereby said toy can be worn on the wrist of a user;

a rigid fluid housing made of non-permeable material for receiving bubble-generating liquid, said wrist strap being connected to said housing;

a lid adapted to open and close said housing, said lid being hingedly connected to said housing;

a bubble-forming ring movably connected to, and which can be completely received within, said fluid housing;

adjusting means for moving said bubble-forming ring between a position in which said bubble-forming ring is received within said housing and a position in which said bubble-forming ring extends out of said housing, said adjusting means also for adjusting and maintaining said bubble-forming ring in a range of elevations relative to said housing; and a decorative surface comprising a timepiece that is releasably attached to said lid.

2. A bubble blowing toy as claimed in claim 1 wherein ridges are provided evenly and radially distributed on a surface of the said bubble-forming ring for retaining and entrapping said bubble-generating liquid thereon.

* * * * *